US011014110B2

(12) United States Patent
Suardika

(10) Patent No.: US 11,014,110 B2
(45) Date of Patent: May 25, 2021

(54) BACKPACK MISTER

(71) Applicant: I Wayan Suardika, Potter valley, CA (US)

(72) Inventor: I Wayan Suardika, Potter valley, CA (US)

(73) Assignee: I Wayan Suardika, San Rafael, CA (US)

( * ) Notice: Subject to any disclaimer, the term of this patent is extended or adjusted under 35 U.S.C. 154(b) by 107 days.

(21) Appl. No.: 16/571,184

(22) Filed: Sep. 15, 2019

(65) Prior Publication Data

US 2021/0078026 A1 Mar. 18, 2021

(51) Int. Cl.
*B05B 11/00* (2006.01)

(52) U.S. Cl.
CPC ..... *B05B 11/3052* (2013.01); *B05B 11/0056* (2013.01)

(58) Field of Classification Search
CPC ..... B05B 11/3052; B05B 11/0056; B05B 7/1413; B05B 7/2475; B05B 9/08; B05B 9/0877; B05B 9/0883; A01M 7/0046
USPC ..... 239/153, 152, 154
See application file for complete search history.

(56) References Cited

U.S. PATENT DOCUMENTS 5,303,847 A * 4/1994 Cottone ..... B05B 9/0861 222/175
5,752,661 A * 5/1998 Lewis ..... B05B 9/0861 222/175
7,832,663 B1 * 11/2010 Cotham ..... A01C 15/02 239/653
8,141,754 B2 * 3/2012 Conner ..... B05B 9/043 222/333
8,556,192 B2 * 10/2013 Wise ..... F04B 17/06 239/146
10,926,280 B2 * 2/2021 Ciavarella ..... B05B 11/3032
2011/0057436 A1 * 3/2011 Schrum ..... B05B 7/2491 285/33
2016/0038960 A1 * 2/2016 Fontaine ..... B05B 9/0888 239/332
2017/0252757 A1 * 9/2017 Peterson ..... A01M 7/0046
2019/0105674 A1 * 4/2019 Fontaine ..... B05B 7/2486
2020/0290072 A1 * 9/2020 Allis ..... B05B 9/0805
2020/0406305 A1 * 12/2020 Beaman ..... B05B 11/0078

* cited by examiner

*Primary Examiner* — Justin M Jonaitis

(57) ABSTRACT

A portable liquid mister assembly capable of being worn on a person's back. It includes a liquid reservoir, a pressure pump and a DC power supply and a misting wand assembly. When a person pulls the trigger of the misting wand, a very fine mist of approximately two-hundred-micron liquid droplets is emitted from the misting head. The liquid inside the reservoir is non-pressurized and becomes pressurized when it enters the pressure pump. Therefore, the liquid reservoir does not have to withstand excessive pressures during use. Spare power supply batteries may be carried in pockets attached to the reservoir. The reservoir holds approximately three gallons of liquid.

3 Claims, 7 Drawing Sheets

BACKPACK MISTER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of agricultural liquid sprayers and more specifically to a portable backpack mister.

In the course of maintaining ideal plant health and growth, it is sometimes necessary to apply liquids carrying nutrients, fertilizers or pest repellents via a spraying method.

Various types of sprayers have been developed and marketed for this purpose. They generally work by pressurizing the container that is holding the liquid and then having the pressurized liquid travel to a spray head to be dispersed on the plant.

However, it has been found that absorption of certain types of beneficial liquids by plants is more effective when the liquid is put under high pressure of approximately two hundred pounds per square inch and forced out as a fine mist where the liquid droplets are approximately two hundred microns in diameter or less. When considering a portable misting assembly, it is not economically efficient to consider using a pressurized tank that would hold liquid under such high pressure. Such a high-pressure tank would also be rather dangerous if it were to rupture accidentally. Existing tanks for portable sprayers are usually pressurized to a maximum of forty-five pounds per square inch. Therefore, the existing technology of current pressurized sprayers is not appropriate for creating fine mist. And therefore, a new and unique method must be employed for the purpose of an effective portable misting assembly.

BRIEF SUMMARY OF THE INVENTION

The primary object of the invention is to provide a portable device to apply a fine liquid mist to plants, shrubs or trees.

Another object of the invention is to provide a misting system that can be worn by the user in a backpack form that includes a misting wand.

Another object of the invention is to provide a misting system that allows the user to quickly and easily swap portable power supplies for extended misting operation.

A further object of the invention is to provide a misting system whose high-pressure pump allows the liquid within a storage reservoir to remain unpressurized until it travels through the pressure pump and is released out of a misting head located at the tip of a misting wand assembly.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a backpack mister comprising: a misting wand, a misting head, a flexible pressure hose, a liquid reservoir housing, a pair of shoulder straps, a DC powered pressure pump, a pressure switch, a portable power supply, a pocket for carrying one or more spare power supplies, a pump retaining housing, a power supply retaining housing, a liquid reservoir housing lid, a two hundred micron filter, a power supply door, a back cushion, said liquid reservoir housing being made of rigid molded plastic, said liquid reservoir housing including a plurality of strap retaining member for securing said shoulder straps, said shoulder straps enabling a person to carry said liquid reservoir housing and associated components on his or her back, said liquid reservoir housing including an aperture for adding or removing liquid, said liquid reservoir housing aperture having cylindrical shoulder having threads that match the internal threads found in said liquid reservoir housing lid, said pocket for carrying one or more spare power supplies attached to the side wall of said liquid reservoir housing, said misting head removably attached to the end of said misting wand, said misting wand including a finger activated trigger member for causing mist to exit from said misting head, said flexible pressure hose, including said two hundred micron filter, attached at one end to the exit port of said pressure switch and at the other end to the said hand held trigger member, said pump retaining housing located within a depression in said liquid reservoir housing, said portable power supply retaining housing located within a second depression in said liquid reservoir housing, said back cushion mounted to the outside surface of said liquid reservoir housing corresponding with and abutting the back torso surface of the user, said power supply door being hinged to said power supply retaining housing and capable of being easily opened to remove or replace said portable power supply, said portable power supply electrically attached by cables to said DC powered pressure pump, said pump retaining housing including a cover plate that is approximately flush with the exterior of said liquid reservoir housing, said pressure switch attached to the exit port of said pressure pump, and said DC powered pressure pump pressurizing the non-pressurized liquid contained within said liquid reservoir housing to approximately two hundred pounds per square inch and said pressurized liquid exiting said misting head at approximately a two hundred micron droplet size when said user squeezes on the trigger of said hand held trigger member.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE DRAWINGS AND PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
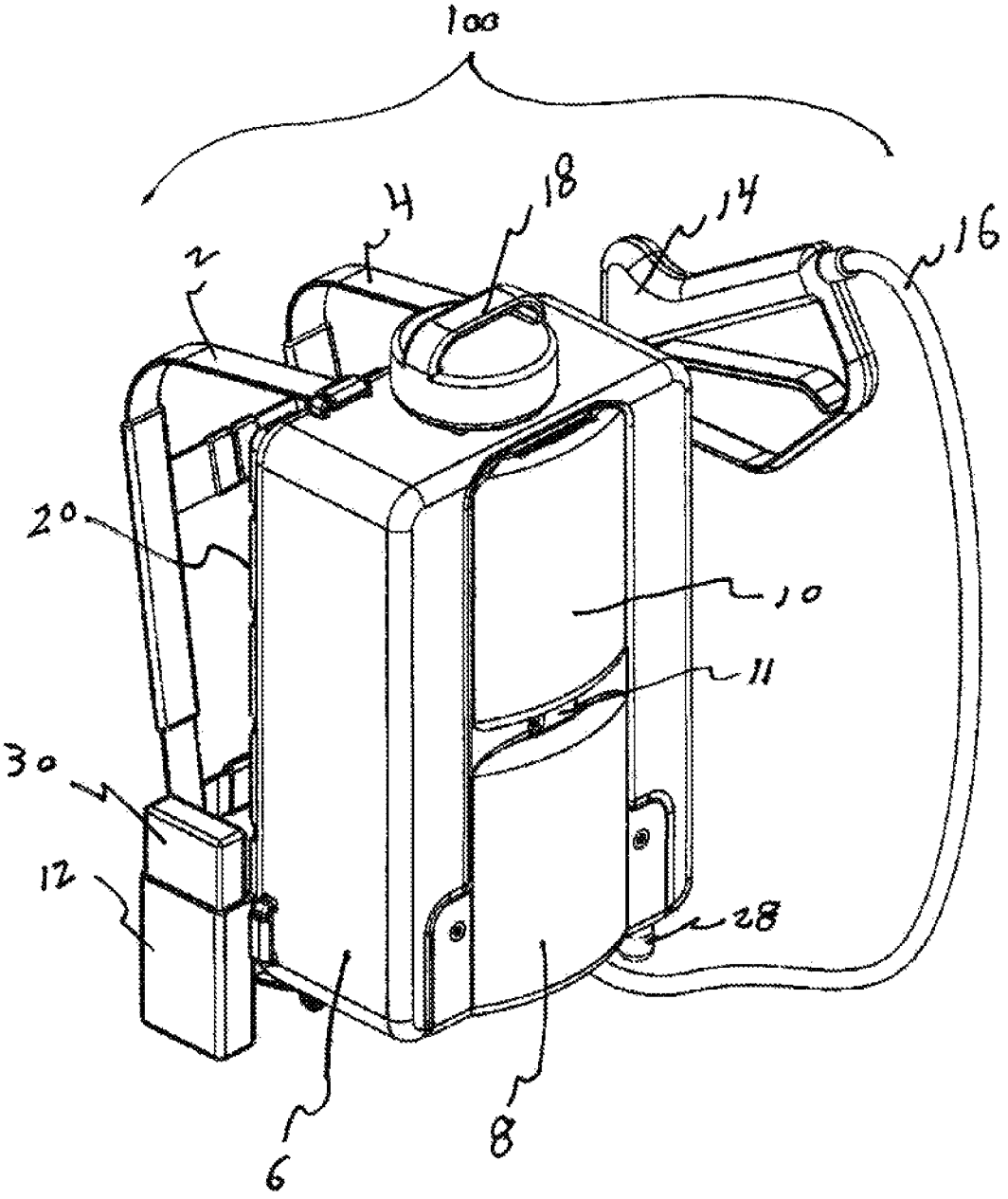
FIG. 1 is a front facing perspective view of the invention.
Figure 5:
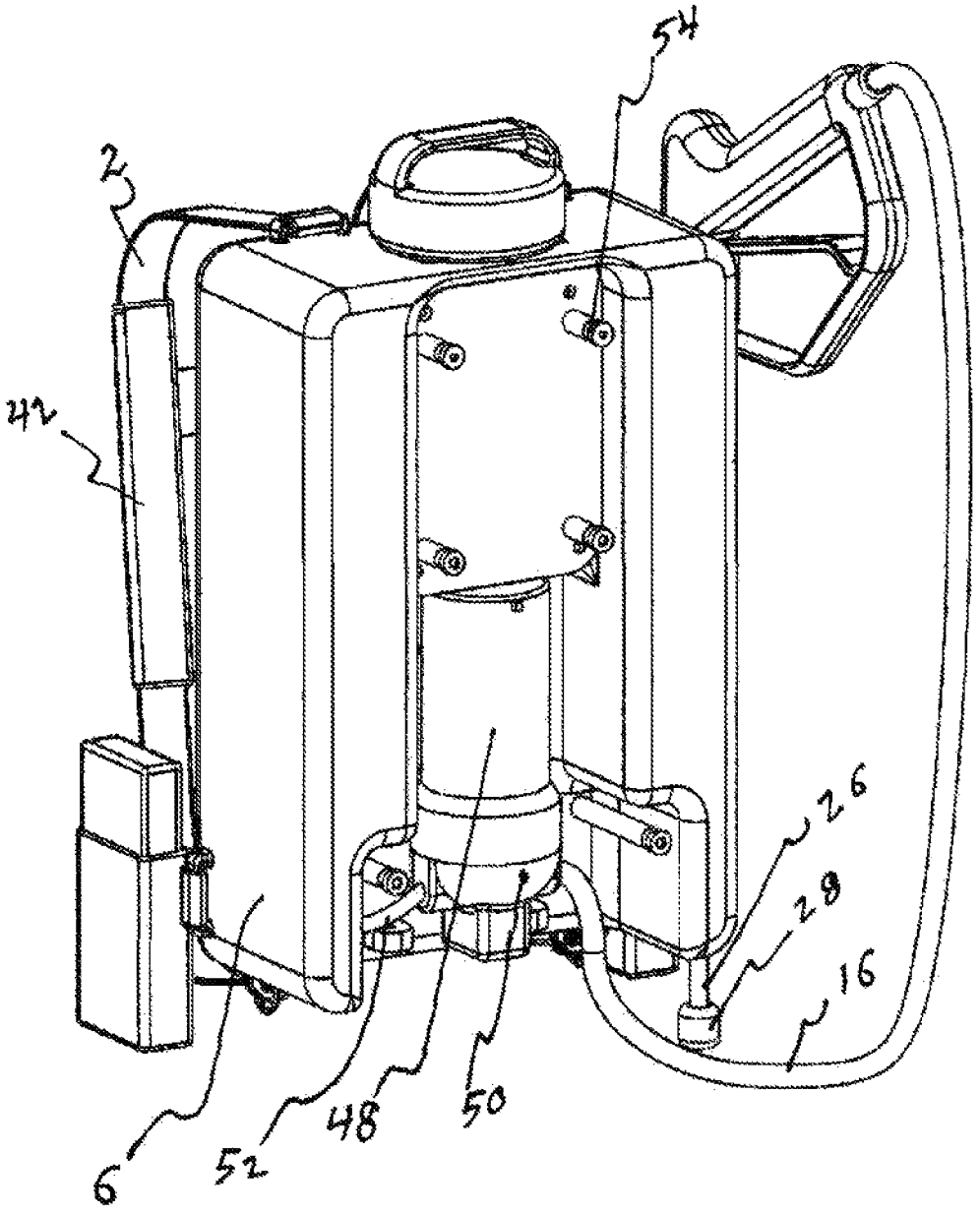
FIG. 5 is a front facing perspective view of the invention with the pump front cover removed and the battery holder removed.
Figure 6:
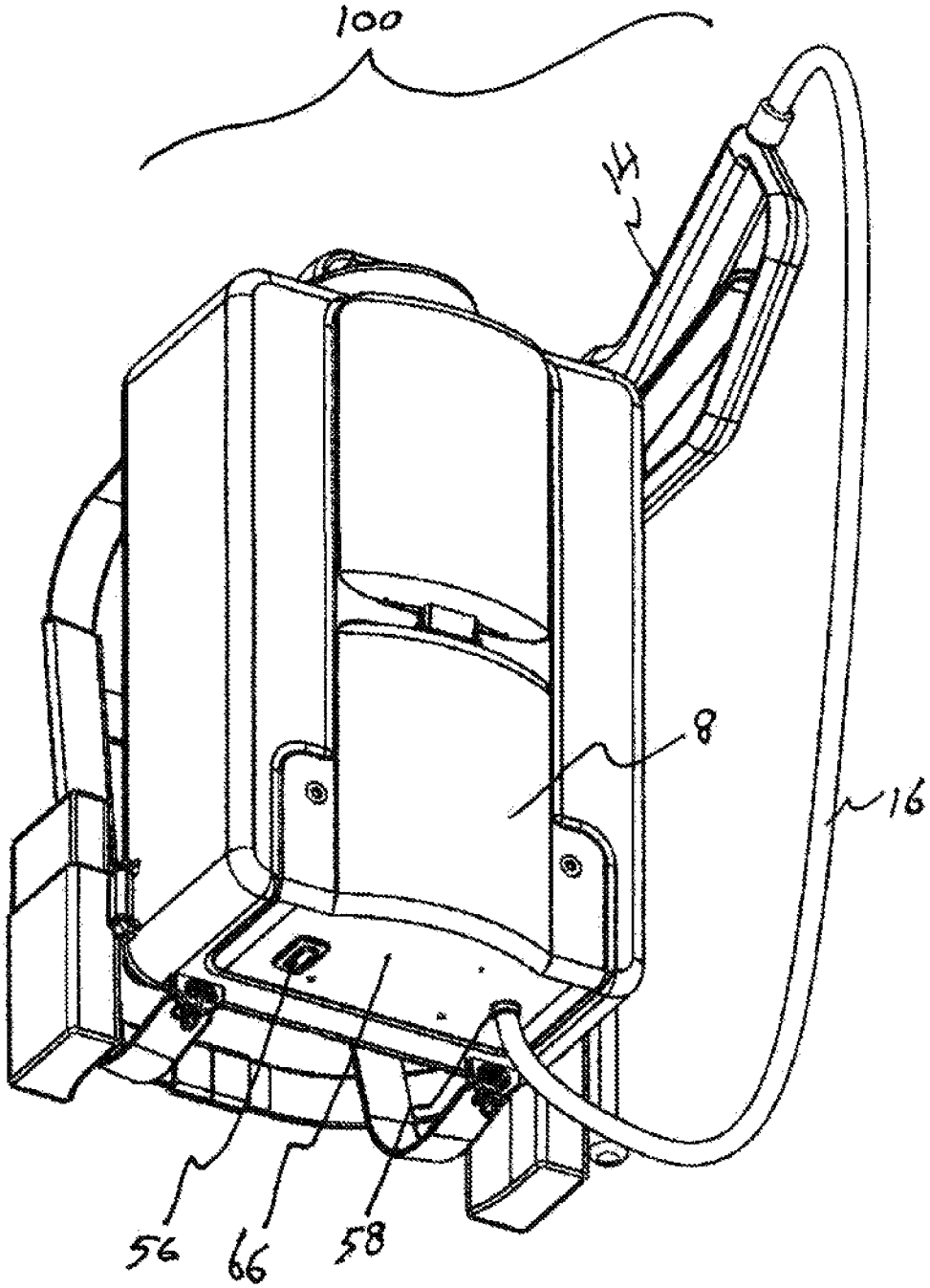
FIG. 6 is a front perspective view showing the underside of the invention.
Figure 7:
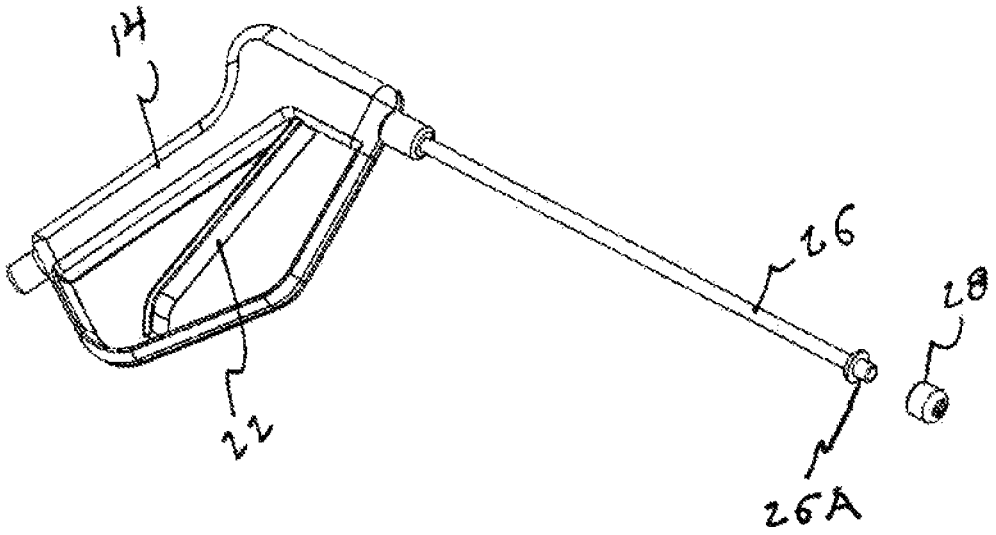
FIG. 7 is a perspective view of the pressure wand of the invention.

Referring now to FIG. 1 we see a front perspective view of the invention 100. A liquid reservoir housing 6 is preferably molded from rigid plastic such as high-density polypropylene. I removable lid 18 can unscrew to allow the user you pour in liquid nutrients into the reservoir 6. A pair of straps 2, 4 allow the entire assembly 100 to be worn on a person's back. Cover plate 8 encloses the pressure pump located behind the plate 8. Cover plate 10 is hingedly connected 11 to the outer front surface of the reservoir 6. A flexible hose 16 capable of operating under high pressure exits the underside of the underside of the invention 100 as shown in FIG. 6 The pump cover plate 8 is actually L shaped as shown in FIG. 6 which shows the under plate 66 as an integral part of front plate 8. Hose 16 exits an aperture 58 located on under plate 66. The hose 16 can be seen exiting a pressure switch assembly 50 located just under pressure pump 48 as shown in FIG. 5. The other end of the hose 16 terminates in hand grip assembly 14. The pressurized liquid then can be released by finger lever 22 so that it can continue out of misting head 28 via rigid tube 26 as shown in FIG. 7. The misting head 28 is removable from the tip of tube 26 via threaded portion 26A as shown in FIG. 7. Battery holding pocket 12 allows the user to retain an extra battery 30 in case the battery 46 inside the unit, as shown in FIG. 3, becomes depleted of power. Additional battery holding pockets may be added to the assembly 100 as shown in FIG. 2 where pocket 32 holds spare battery 34.

Figure 2:
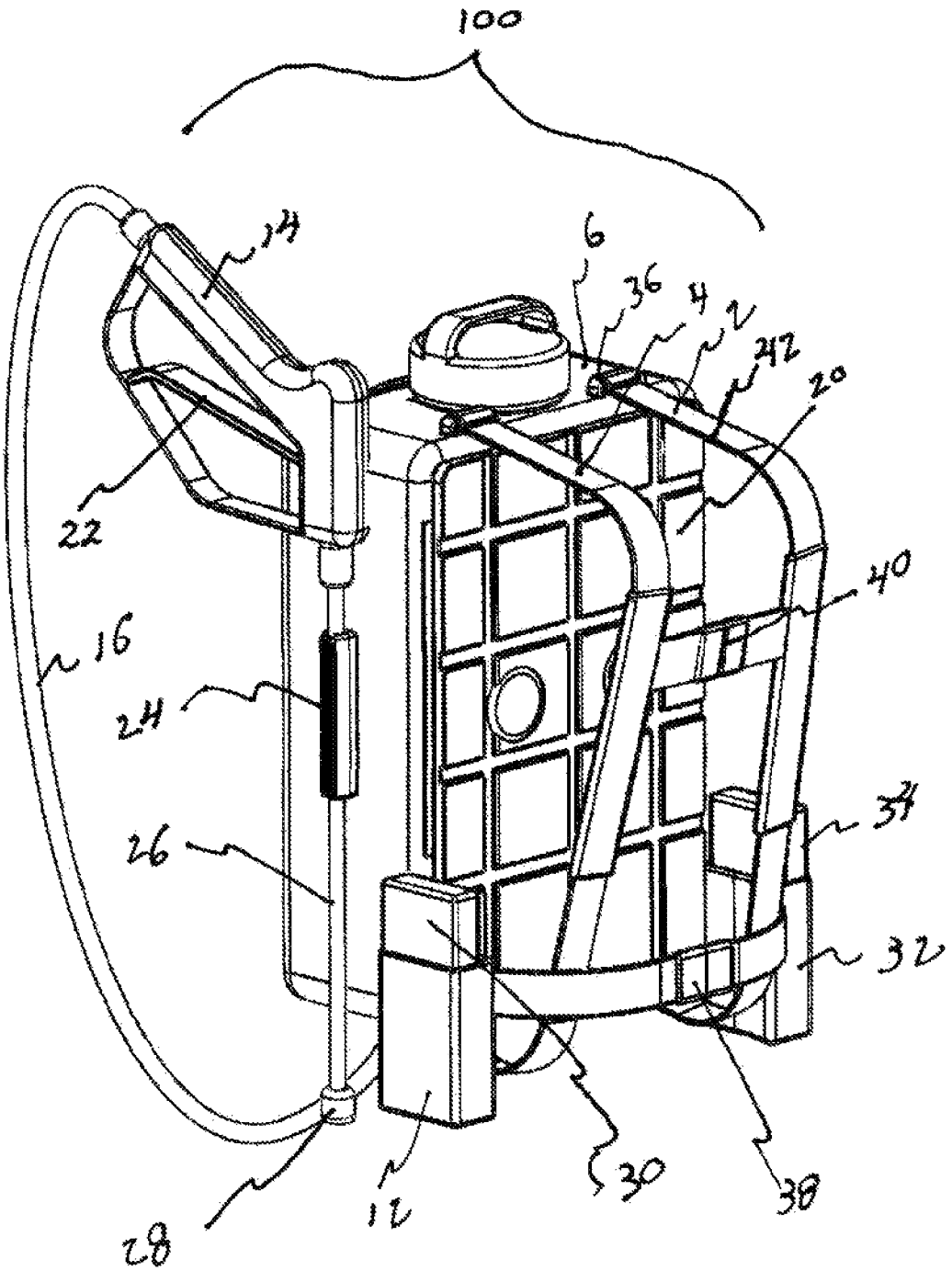
FIG. 2 is a rear facing perspective view of the invention.
Figure 3:
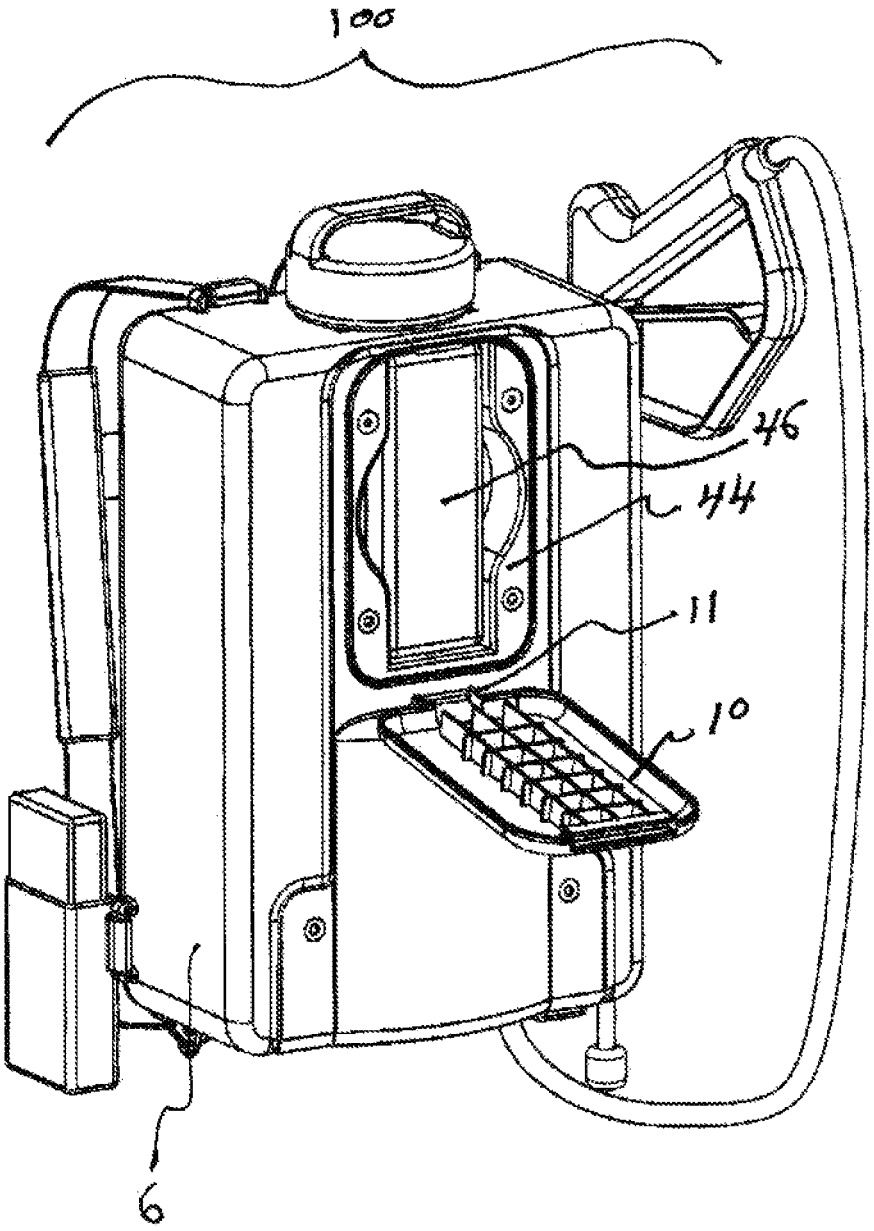
FIG. 3 is a front facing perspective view of the invention with the battery door in the open position.

FIG. 2 is a rear perspective view of the invention 100 that clearly shows support straps 4, 2 as they are held by strap retaining brackets 36 which are molded into the structure of the reservoir housing 6. Battery holding pockets 12, 32 hold spare batteries 30, 34 so that the user can extend his or her time in the field when the original battery 46 becomes depleted during use. Resilient pad 20 attaches to reservoir 6 and forms a cushion between the user's back and the reservoir 6. Molded in wand holder 24 removably retains wand 26. Finger trigger 22 activates the mist when pulled by the user. Connecting clips 38, 40 help retain straps 2, 4 when the assembly 100 is being worn by a user. Shoulder pads 42 protect the user's shoulders during use.

FIG. 3 is a perspective view showing the battery door 10 opened via hinge 11 and revealing battery power supply 46 within battery housing 44. The housing 44 is inset into the reservoir 6 so that the outer surface of the assembly 100 is relatively smooth.

Figure 4:
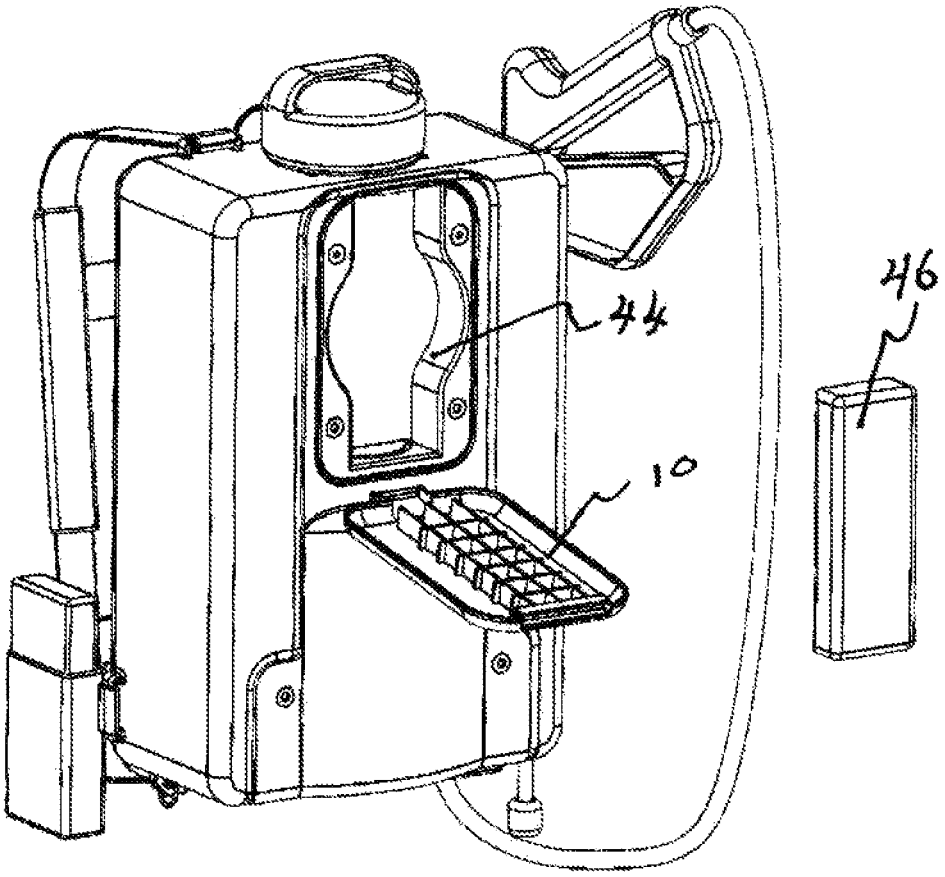
FIG. 4 is a front facing perspective view of the invention with the battery removed.

FIG. 4 is a perspective view of the invention 100 showing the battery 46 removed from battery housing 44. The battery can be recharged and replaced as needed.

FIG. 5 is a perspective view of the invention 100 with the pump cover 8 removed revealing pressure pump 52 and pressure switch 50. The battery housing 44 is also removed and is held in place on the outer surface of the reservoir by attachment to standoffs 54. The pressure pump 48 produces approximately two hundred pounds per square inch of pressure which is ideal for causing a misting action as liquid exits misting head 28. Pressure switch 50 automatically turns off pump 48 after it has reached approximately two hundred pounds per square inch pressure. The liquid within reservoir 6 can remain unpressurized and therefore does not introduce undo pressure on the reservoir 6 walls. The pressure pump 48 and power supply are connected by electrical cables. An on-off switch 56 interrupts the flow of electricity allowing the user to turn on or off the pressure pump 48

FIG. 6 is a perspective view showing the underside of the assembly 100. The pump housing panel 8 is L shaped and includes panel 66 to further seal off the pump 48 and pressure switch 50 from the outer environment. Switch 56 completes the circuit from battery 46 to pump 48. Flexible pressure hose 16 exits aperture 58. The hose 16 enters hand held assembly 14 and continues to connect with rigid wand tube 26 as shown in FIG. 7.

FIG. 7 shows the hand held gun shaped handle and finger actuation trigger 22, which when pulled, causes fine mist of approximately two hundred-micron droplets to be expelled from misting head 28. The resulting misting assembly 100 allows the user to apply liquid nutrients or pest repellents to plants, shrubs or trees allowing the liquid to more completely be absorbed into the horticultural item being misted.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A backpack mister comprising:

a misting wand;

a misting head;

a flexible pressure hose;

a liquid reservoir housing;

a pair of shoulder straps;

a DC powered pressure pump;

a pressure switch;

a portable power supply;

at least one pocket for carrying one or more spare power supplies;

a pump retaining housing;

one or more power supply retaining housings;

a liquid reservoir housing lid;

a two hundred micron filter;

a power supply door;

a back cushion;

said liquid reservoir housing being made of rigid molded plastic;

said liquid reservoir housing including a plurality of strap retaining member for securing said shoulder straps;

said shoulder straps enabling a person to carry said liquid reservoir housing and associated components on his or her back;

said liquid reservoir housing including an aperture for adding or removing liquid;

said liquid reservoir housing aperture having a cylindrical shoulder with threads that match a set of internal threads found in said liquid reservoir housing lid;

said at least one pocket for carrying one or more spare power supplies attached to a side wall of said liquid reservoir housing;

said misting head removably attached to said misting wand;

said misting wand including a hand held trigger member for causing mist to exit from said misting head;

said flexible pressure hose attached on one end to the exit port of said pressure switch and at the other end to the said hand held trigger member;

said pump retaining housing located within a depression in said liquid reservoir housing;

said portable power supply retaining housing located within a second depression in said liquid reservoir housing;

said back cushion mounted to the outside surface of said liquid reservoir housing corresponding with a back-torso surface of the user;

said power supply door being hinged to said power supply retaining housing and capable of being easily opened to remove or replace said portable power supply;

said portable power supply electrically attached by cables to said DC powered pressure pump;

said pump retaining housing including a cover plate that is approximately flush with the exterior of said liquid reservoir housing;

said pressure switch attached to the exit port of said pressure pump; and said DC powered pressure pump pressurizing the non-pressurized liquid contained within said liquid reservoir housing to approximately two hundred pounds per square inch and said pressurized liquid exiting said misting head at approximately a two-hundred-micron droplet size when said user squeezes on the trigger of said hand held trigger member.

2. A backpack mister as claimed in claim 1 wherein said liquid reservoir housing holds approximately three gallons of liquid.

3. A Backpack mister as claimed in claim 1 wherein an on-off switch mounted on the outer surface of said pump housing cover plate is used to turn on and off said pressure pump.

* * * * *